US008437675B2

(12) United States Patent
Ishii et al.

(10) Patent No.: US 8,437,675 B2
(45) Date of Patent: May 7, 2013

(54) FIXING DEVICE AND IMAGE FORMING APPARATUS INCORPORATING SAME HAVING A LAMINATED HEATER WITH A FLEXIBLE HEAT GENERATION SHEET

(75) Inventors: Kenji Ishii, Kawasaki (JP); Masaaki Yoshikawa, Tokyo (JP); Hiroshi Yoshinaga, Ichikawa (JP); Naoki Iwaya, Choufu (JP); Yoshiki Yamaguchi, Sagamihara (JP); Yutaka Ikebuchii, Chigasaki (JP); Tetsuo Tokuda, Kawasaki (JP); Takahiro Imada, Yokohama (JP); Takamasa Hase, Kawasaki (JP); Toshihiko Shimokawa, Zama (JP); Ippei Fujimoto, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 131 days.

(21) Appl. No.: 12/946,347

(22) Filed: Nov. 15, 2010

(65) Prior Publication Data

US 2011/0129268 A1 Jun. 2, 2011

(30) Foreign Application Priority Data

Nov. 30, 2009 (JP) ..... 2009-271998
Feb. 1, 2010 (JP) ..... 2010-020092

(51) Int. Cl.
*G03G 15/20* (2006.01)

(52) U.S. Cl.
USPC ..... 399/333

(58) Field of Classification Search ..... 399/333, 399/320, 321, 328, 329, 335; 219/216
See application file for complete search history.

(56) References Cited

U.S. PATENT DOCUMENTS 4,883,941 A 11/1989 Martin et al.
5,162,634 A 11/1992 Kusaka et al.
5,839,032 A 11/1998 Yasui et al.
6,628,916 B2 9/2003 Yasui et al.

(Continued)

FOREIGN PATENT DOCUMENTS

CN 87 1 05395 A 5/1988
CN 1086613 A 5/1994

(Continued)

OTHER PUBLICATIONS

Extended Search Report issued Feb. 24, 2012 in Europe Application No. 10191820.9.

(Continued)

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

A fixing device includes a pressing member pressed against a fixing member to form a nip between the pressing member and the fixing member through which a recording medium bearing a toner image passes. A heater support provided inside the fixing member supports a laminated heater. The laminated heater is provided between the fixing member and the heater support and includes a flexible, first heat generation sheet that includes an insulating base layer, at least one resistant heat generation layer provided on the base layer to generate heat, and at least one electrode layer provided on the base layer to supply power to the at least one resistant heat generation layer.

14 Claims, 10 Drawing Sheets

U.S. PATENT DOCUMENTS

| | | | | |
|---|---|---|---|---|
| 6,636,709 | B2 | 10/2003 | Furukawa et al. | |
| 6,778,790 | B2 | 8/2004 | Yoshinaga et al. | |
| 6,778,804 | B2 | 8/2004 | Yoshinaga et al. | |
| 6,785,505 | B2 | 8/2004 | Yasui et al. | |
| 6,813,464 | B2 | 11/2004 | Amita et al. | |
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |
| 6,937,827 | B2 | 8/2005 | Katoh et al. | |
| 7,022,944 | B2 | 4/2006 | Yoshinaga et al. | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,344,615 | B2 | 3/2008 | Sato et al. | |
| 7,379,698 | B2 | 5/2008 | Yoshinaga | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,546,049 | B2 | 6/2009 | Ehara et al. | |
| 7,570,910 | B2 | 8/2009 | Ishii | |
| 7,702,271 | B2 | 4/2010 | Yamada et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 2001/0032835 | A1* | 10/2001 | Murooka et al. | 219/216 |
| 2003/0063931 | A1 | 4/2003 | Sanpei et al. | |
| 2003/0183610 | A1 | 10/2003 | Okabayashi et al. | |
| 2006/0029411 | A1 | 2/2006 | Ishii et al. | |
| 2006/0257183 | A1 | 11/2006 | Ehara et al. | |
| 2007/0014600 | A1 | 1/2007 | Ishii et al. | |
| 2008/0063443 | A1 | 3/2008 | Yoshinaga et al. | |
| 2008/0253789 | A1 | 10/2008 | Yoshinaga et al. | |
| 2008/0298862 | A1 | 12/2008 | Shinshi | |
| 2008/0317532 | A1 | 12/2008 | Ehara et al. | |
| 2009/0003867 | A1 | 1/2009 | Fujimoto | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0148205 | A1 | 6/2009 | Seo et al. | |
| 2009/0169232 | A1 | 7/2009 | Kunii et al. | |
| 2009/0245865 | A1 | 10/2009 | Shinshi et al. | |
| 2009/0245897 | A1 | 10/2009 | Seo et al. | |
| 2009/0252521 | A1 | 10/2009 | Takami | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |

FOREIGN PATENT DOCUMENTS

| | | |
|---|---|---|
| EP | 0 256 770 B1 | 2/1988 |
| JP | 10-213984 | 8/1998 |
| JP | 2884714 | 2/1999 |
| JP | 2001-117405 | 4/2001 |
| JP | 3298354 | 4/2002 |
| JP | 3592485 | 9/2004 |
| JP | 2007-334205 | 12/2007 |
| JP | 2008-146010 | 6/2008 |
| JP | 2008-158482 | 7/2008 |
| JP | 2008-216928 | 9/2008 |
| JP | 2009-251137 | 10/2009 |
| WO | WO 03/102699 | 12/2003 |

OTHER PUBLICATIONS

Chinese Office Action issued Jun. 28, 2012, in China Patent Application No. 201010559368.3.

* cited by examiner

FIG. 11A
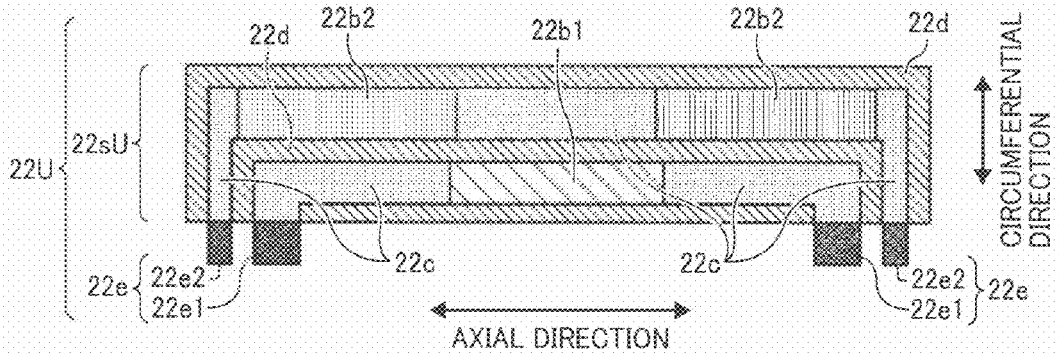
FIG. 11B
ELEMENTS OF DIVIDED REGIONS
| | | |
|---|---|---|
| (2, 1) | (2, 2) | (2, 3) |
| (1, 1) | (1, 2) | (1, 3) |
FIG. 12
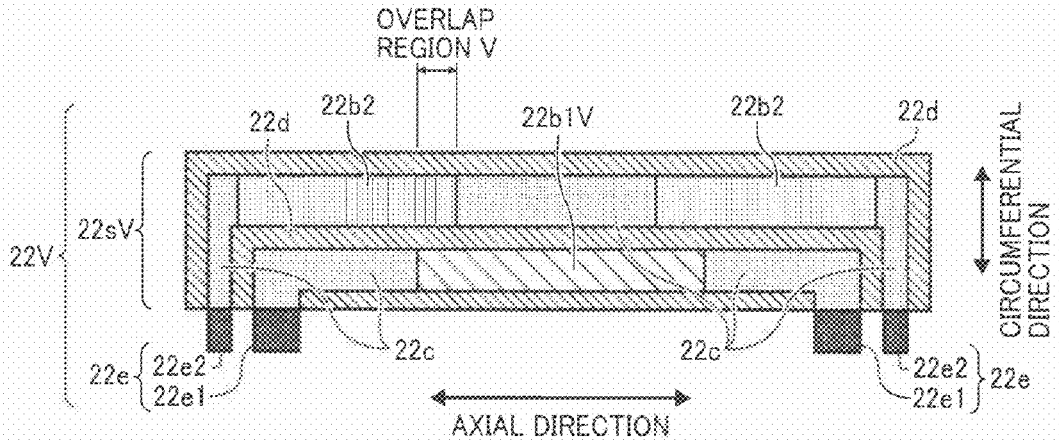

FIXING DEVICE AND IMAGE FORMING APPARATUS INCORPORATING SAME HAVING A LAMINATED HEATER WITH A FLEXIBLE HEAT GENERATION SHEET

CROSS-REFERENCE TO RELATED APPLICATIONS

The present application is based on and claims priority to Japanese Patent Application Nos. 2009-271998, filed on Nov. 30, 2009, and 2010-020092, filed on Feb. 1, 2010, in the Japan Patent Office, each of which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically fault an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include an endless fixing belt formed into a loop and a resistant heat generator provided inside the loop formed by the fixing belt to heat the fixing belt, to shorten a warm-up time or a time to first print (hereinafter also "first print time"). Specifically, the resistant heat generator faces the inner circumferential surface of the fixing belt across a slight gap. A pressing roller presses against a nip formation member also provided inside the loop formed by the fixing belt via the fixing belt to form a nip between the fixing belt and the pressing roller through which the recording medium bearing the toner image passes. As the recording medium bearing the toner image passes through the nip, the fixing belt heated by the resistant heat generator and the pressing roller apply heat and pressure to the recording medium to fix the toner image on the recording medium.

With the above configuration, the slight gap provided between the resistant heat generator and the fixing belt prevents wear of the resistant heat generator and the fixing belt while at the same time providing the shortened warm-up time and the shortened first print time described above. Accordingly, even when the fixing belt rotates at a high speed, the resistant heat generator heats the fixing belt to a desired fixing temperature with reduced wear of the fixing belt and the resistant heat generator.

However, rotation and vibration of the pressing roller repeatedly applies mechanical stress to the resistant heat generator via the fixing belt repeatedly, which bends the resistant heat generator. The repeated bending of the resistant heat generator causes fatigue failure and concomitant breakage or disconnection of the wiring of the resistant heat generator, resulting in faulty heating of the fixing belt.

To counteract this effect, it is conceivable that a plurality of resistant heat generators may be arranged in an axial direction of the fixing belt to heat the fixing belt partially or entirely in the axial direction of the fixing belt by turning on and off each resistant heat generator independently, so as to heat the fixing belt according to the size of the recording medium. However, since the resistant heat generators do not overlap, and therefore a predetermined gap arises between the adjacent two resistant heat generators. Accordingly, insufficient heat is generated in the gap between adjacent resistant heat generators, resulting in uneven temperature distribution of the fixing belt in the axial direction of the fixing belt.

BRIEF SUMMARY OF THE INVENTION

This specification describes below an improved fixing device. In one exemplary embodiment of the present invention, the fixing device fixes a toner image on a recording medium and includes an endless belt-shaped fixing member, a pressing member, a laminated heater, and a heater support. The fixing member rotates in a predetermined direction of rotation, and is formed in a loop. The pressing member contacts an outer circumferential surface of the fixing member to form a nip between the pressing member and the fixing member through which the recording medium bearing the toner image passes. The laminated heater faces an inner circumferential surface of the fixing member to heat the fixing member. The heater support is provided inside the loop formed by the fixing member to support the laminated heater. The laminated heater is provided between the fixing member and the heater support and includes a flexible, first heat generation sheet having a predetermined length in a circumferential direction of the fixing member and a width in an axial direction of the fixing member. The first heat generation sheet includes an insulating base layer, at least one resistant heat generation layer provided on the base layer to generate heat, and at least one electrode layer provided on the base layer to supply power to the at least one resistant heat generation layer.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein:

FIG. 11A is a plan view of a laminated heater as one variation of the laminated heater shown in FIG. 4;

FIG. 11B is a lookup table of a matrix showing regions on the laminated heater shown in FIG. 11A;

FIG. 12 is a plan view of a laminated heater as another variation of the laminated heater shown in FIG. 4;

DETAILED DESCRIPTION OF THE INVENTION

Figure 1:
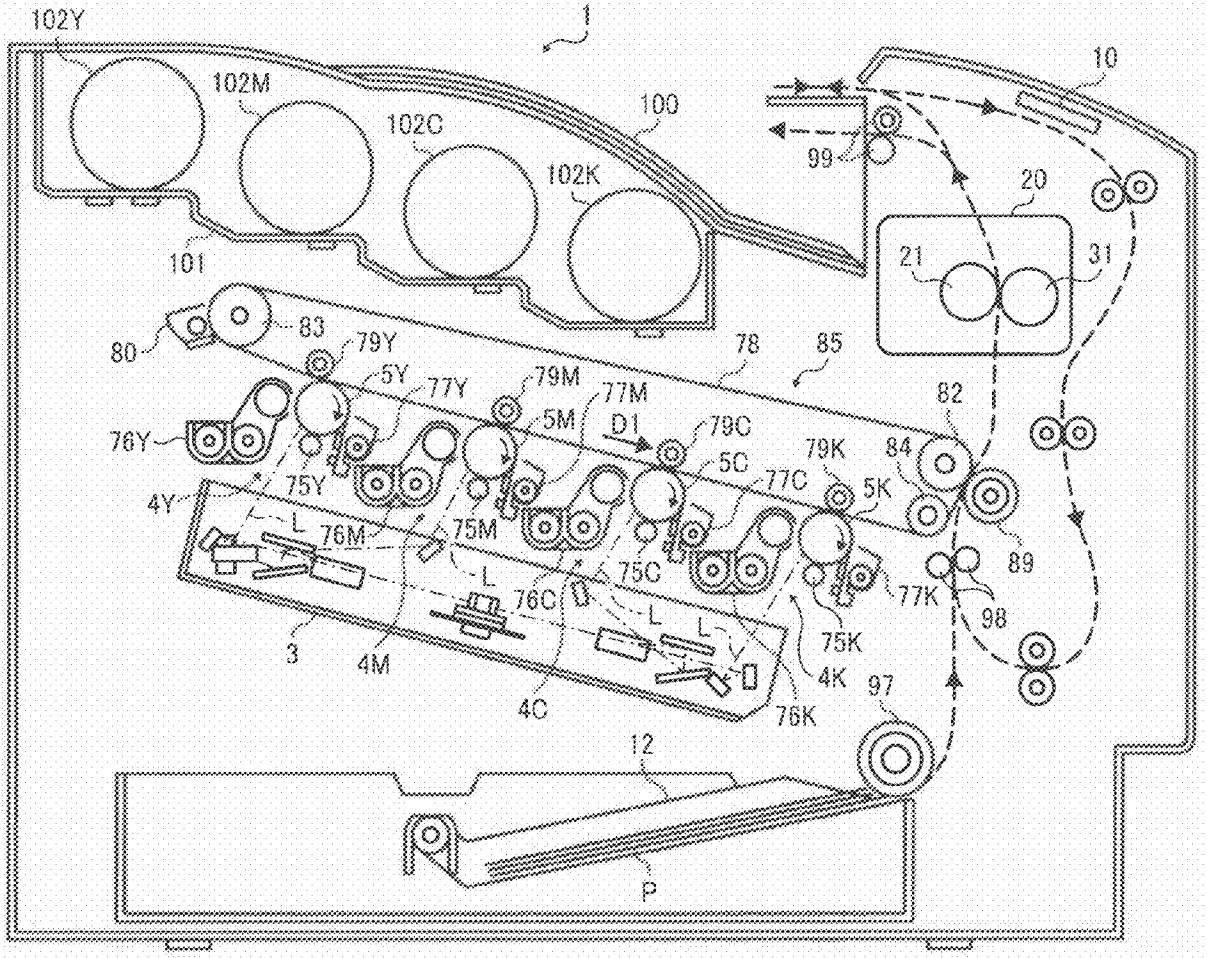
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 1, the image forming apparatus 1 includes an exposure device 3, image forming devices 4Y, 4M, 4C, and 4K, a controller 10, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing sleeve 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction D1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction D1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The paper tray 12 is provided in a lower portion of the image forming apparatus 1, and loads a plurality of recording media P (e.g., transfer sheets). The feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip.

At the second transfer nip, the second transfer roller 89 and the second transfer backup roller 82 sandwich the intermediate transfer belt 78. The second transfer roller 89 transfers the color toner image formed on the intermediate transfer belt 78 onto the recording medium P fed by the registration roller pair 98 at the second transfer nip formed between the second transfer roller 89 and the intermediate transfer belt 78. Thus, the desired color toner image is formed on the recording medium P. After the transfer of the color toner image, residual toner, which has not been transferred onto the recording medium P, remains on the intermediate transfer belt 78.

The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

The recording medium P bearing the color toner image is sent to the fixing device 20. In the fixing device 20, the fixing sleeve 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Referring to FIGS. 2 to 8, the following describes the structure of the fixing device 20.

Figure 2:
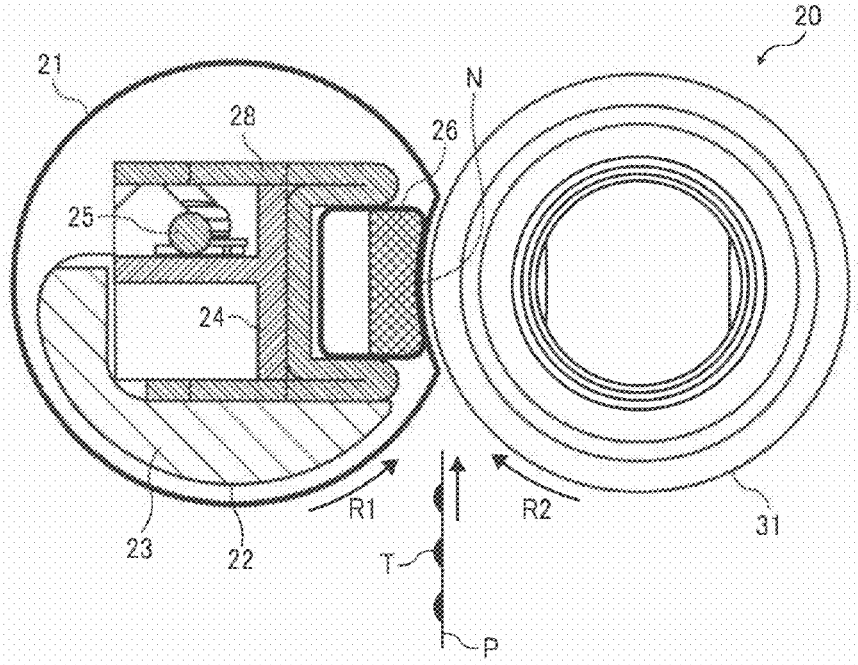
FIG. 2 is a sectional view of a fixing device included in the image forming apparatus shown in FIG. 1.

FIG. 2 is a vertical sectional view of the fixing device 20. As illustrated in FIG. 2, the fixing device 20 further includes a laminated heater 22, a heater support 23, a terminal stay 24, a power supply wire 25, a nip formation member 26, and a core holder 28.

As illustrated in FIG. 2, the fixing sleeve 21 is a rotatable endless belt serving as a fixing member or a rotary fixing member. The pressing roller 31 serves as a pressing member or a rotary pressing member that contacts an outer circumferential surface of the fixing sleeve 21. The nip formation member 26 is provided inside a loop formed by the fixing sleeve 21, and is pressed against the pressing roller 31 via the fixing sleeve 21 to form a nip N between the pressing roller 31 and the fixing sleeve 21 through which the recording medium P passes. The laminated heater 22 is provided inside the loop formed by the fixing sleeve 21, and contacts or is disposed close to an inner circumferential surface of the fixing sleeve 21 to heat the fixing sleeve 21 directly or indirectly. The heater support 23 is provided inside the loop formed by the fixing sleeve 21 to support the laminated heater 22 at a predetermined position in such a manner that the laminated heater 22 is provided between the heater support 23 and the fixing sleeve 21. According to this exemplary embodiment, the laminated heater 22 contacts the inner circumferential surface of the fixing sleeve 21 to heat the fixing sleeve 21 directly.

Figure 3A:
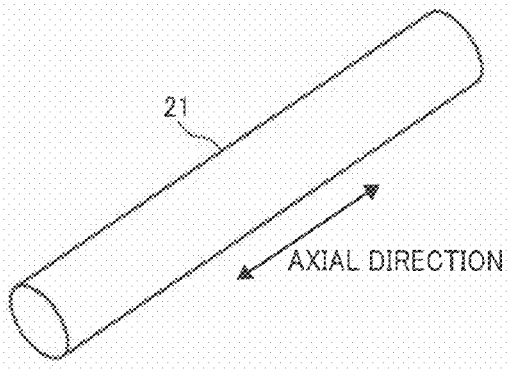
FIG. 3A is a perspective view of a fixing sleeve included in the fixing device shown in FIG. 2.
Figure 3B:
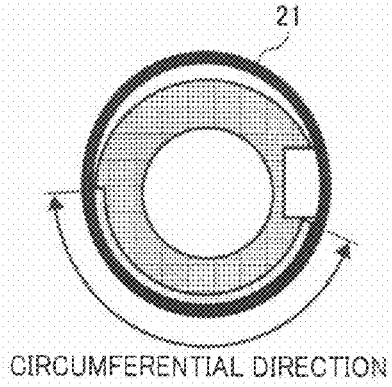
FIG. 3B is a sectional view of the fixing sleeve shown in FIG. 3A.

FIG. 3A is a perspective view of the fixing sleeve 21. FIG. 3B is a sectional view of the fixing sleeve 21. As illustrated in FIG. 3A, an axial direction of the fixing sleeve 21 corresponds to a long axis, that is, a longitudinal direction, of the pipe-shaped fixing sleeve 21. As illustrated in FIG. 3B, a circumferential direction of the fixing sleeve 21 extends along a circumference of the pipe-shaped fixing sleeve 21. The fixing sleeve 21 is a flexible, pipe-shaped endless belt having a width in the axial direction of the fixing sleeve 21, which corresponds to a width of a recording medium P passing through the nip N between the fixing sleeve 21 and the pressing roller 31. For example, the fixing sleeve 21 is constructed of a base layer and at least a release layer provided on the base layer. The base layer is made of a metal material and has a thickness in a range of from about 30 μm to about 50 μm. The fixing sleeve 21 has an outer diameter of about 30 mm. The base layer of the fixing sleeve 21 includes a conductive metal material such as iron, cobalt, nickel, or an alloy of those.

The release layer of the fixing sleeve 21 is a tube covering the base layer, and has a thickness of about 50 μm. The release layer includes a fluorine compound such as tetrafluoroethylene-perfluoroalkylvinylether copolymer (PFA). The release layer facilitates separation of toner of a toner image T on the recording medium P, which contacts the outer circumferential surface of the fixing sleeve 21 directly, from the fixing sleeve 21.

The pressing roller 31 depicted in FIG. 2 is constructed of a metal core including a metal material such as aluminum or copper; a heat-resistant elastic layer provided on the metal core and including silicon rubber (e.g., solid rubber); and a release layer provided on the elastic layer. The pressing roller 31 has an outer diameter of about 30 mm. The elastic layer has a thickness of about 2 mm. The release layer is a PFA tube covering the elastic layer and has a thickness of about 50 μm. A heat generator, such as a halogen heater, may be provided inside the metal core as needed. A pressing mechanism presses the pressing roller 31 against the nip formation member 26 via the fixing sleeve 21 to form the nip N between the pressing roller 31 and the fixing sleeve 21. For example, a portion of the pressing roller 31 contacting the fixing sleeve 21 causes a concave portion of the fixing sleeve 21 at the nip N. Thus, the recording medium P passing through the nip N moves along the concave portion of the fixing sleeve 21.

A driving mechanism drives and rotates the pressing roller 31, which presses the fixing sleeve 21 against the nip formation member 26, clockwise in FIG. 2 in a rotation direction R2. Accordingly, the fixing sleeve 21 rotates in accordance with rotation of the pressing roller 31 counterclockwise in FIG. 2 in a rotation direction R1.

A long axis, that is, a longitudinal direction, of the nip formation member 26 corresponds to the axial direction of the fixing sleeve 21. At least a portion of the nip formation member 26 that is pressed against the pressing roller 31 via the fixing sleeve 21 includes a heat-resistant elastic material such as fluorocarbon rubber. The core holder 28 holds and fixes the nip formation member 26 at a predetermined position inside the loop formed by the fixing sleeve 21. A portion of the nip formation member 26 that contacts the inner circumferential surface of the fixing sleeve 21 may include a slidable and durable material such as Teflon® sheet.

The core holder 28 is made of sheet metal, and has a width in a long axis thereof, that is, a longitudinal direction, corresponding to the width of the fixing sleeve 21 in the axial direction of the fixing sleeve 21. The core holder 28 is a rigid member having an H-like shape in cross-section, and is provided at substantially a center position inside the loop formed by the fixing sleeve 21.

The core holder 28 holds the respective components provided inside the loop formed by the fixing sleeve 21 at predetermined positions. For example, the core holder 28 includes a first concave portion facing the pressing roller 31, which houses and holds the nip formation member 26. In other words, the core holder 28 is disposed opposite the pressing roller 31 via the nip formation member 26 to support the nip formation member 26. Accordingly, even when the pressing roller 31 presses the fixing sleeve 21 against the nip formation member 26, the core holder 28 prevents substantial deformation of the nip formation member 26. In addition, the nip formation member 26 protrudes from the core holder 28 slightly toward the pressing roller 31. Accordingly, the core holder 28 is isolated from and does not contact the fixing sleeve 21 at the nip N.

The core holder 28 further includes a second concave portion disposed back-to-back to the first concave portion, which houses and holds the terminal stay 24 and the power supply wire 25. The terminal stay 24 has a width in a long axis thereof, that is, a longitudinal direction, corresponding to the width of the fixing sleeve 21 in the axial direction of the fixing sleeve 21, and is T-shaped in cross-section. The power supply wire 25 extends on the terminal stay 24, and transmits power supplied from an outside of the fixing device 20. A part of an outer circumferential surface of the core holder 28 holds the heater support 23 that supports the laminated heater 22. In FIG. 2, the core holder 28 holds the heater support 23 in a lower half region inside the loop formed by the fixing sleeve 21, that is, in a semicircular region provided upstream from the nip N in the rotation direction R1 of the fixing sleeve 21. The heater support 23 may be adhered to the core holder 28 to facilitate assembly. Alternatively, the heater support 23 need not be adhered to the core holder 28 to prevent heat transmission from the heater support 23 to the core holder 28.

The heater support 23 supports the laminated heater 22 in such a manner that the laminated heater 22 either contacts the inner circumferential surface of the fixing sleeve 21 or the laminated heater 22 is disposed close to the inner circumferential surface of the fixing sleeve 21 across a predetermined gap. Accordingly, the heater support 23 includes an arc-shaped outer circumferential surface having a predetermined circumferential length and disposed along the inner circumferential surface of the circular fixing sleeve 21 in cross-section.

The heater support 23 may have a heat resistance that resists heat generated by the laminated heater 22, a strength sufficient to support the laminated heater 22 without being deformed by the fixing sleeve 21 when the rotating fixing sleeve 21 contacts the laminated heater 22, and sufficient heat insulation so that heat generated by the laminated heater 22 is not transmitted to the core holder 28 but which does transmit the heat to the fixing sleeve 21. For example, the heater support 23 may be molded foam including polyimide resin. When the laminated heater 22 is configured to contact the inner circumferential surface of the fixing sleeve 21, the rotating fixing sleeve 21 applies a force that pulls the laminated heater 22 to the nip N to the laminated heater 22. To address this force, the heater support 23 may include the molded foam including polyimide resin that provides the heater support 23 with a strength sufficient to support the laminated heater 22 without being deformed. Alternatively, a supplemental solid resin member may be provided inside the molded foam including polyimide resin to improve rigidity.

Figure 4:
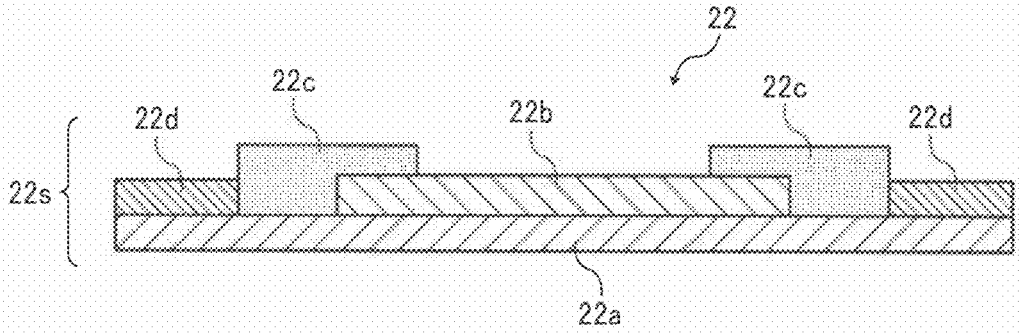
FIG. 4 is a sectional view of a laminated heater included in the fixing device shown in FIG. 2.

FIG. 4 is a sectional view of the laminated heater 22. As illustrated in FIG. 4, the laminated heater 22 includes a heat generation sheet 22*s*. The heat generation sheet 22*s* includes a base layer 22*a* having insulation, a resistant heat generation layer 22*b* provided on the base layer 22*a* and including conductive particles dispersed in a heat-resistant resin, an electrode layer 22*c* provided on the base layer 22*a* to supply power to the resistant heat generation layer 22*b*, and an insulation layer 22*d* provided on the base layer 22*a*. The heat generation sheet 22*s* is flexible, and has a predetermined width in the axial direction of the fixing sleeve 21 depicted in FIG. 3A and a predetermined length in the circumferential direction of the fixing sleeve 21 depicted in FIG. 3B.

The insulation layer 22*d* insulates one resistant heat generation layer 22*b* from another adjacent resistant heat generation layer 22*b* of a different power supply system, and insulates an edge of the heat generation sheet 22*s* from an outside of the heat generation sheet 22*s*.

The heat generation sheet 22*s* has a thickness in a range of from about 0.1 mm to about 1.0 mm, and has a flexibility sufficient to wrap around the heater support 23 depicted in FIG. 2 at least along an outer circumferential surface of the heater support 23.

The base layer 22*a* is a thin, elastic film including a certain heat-resistant resin such as polyethylene terephthalate (PET) or polyimide resin. For example, the base layer 22*a* may be a film including polyimide resin to provide heat resistance, insulation, and a certain level of flexibility.

The resistant heat generation layer 22*b* is a thin, conductive film in which conductive particles, such as carbon particles and metal particles, are uniformly dispersed in a heat-resistant resin such as polyimide resin. When power is supplied to the resistant heat generation layer 22*b*, internal resistance of the resistant heat generation layer 22*b* generates Joule heat. The resistant heat generation layer 22*b* is manufactured by coating the base layer 22*a* with a coating compound in which conductive particles, such as carbon particles and metal particles, are dispersed in a precursor including a heat-resistant resin such as polyimide resin.

Alternatively, the resistant heat generation layer 22*b* may be manufactured by providing a thin conductive layer including carbon particles and/or metal particles on the base layer 22*a* and then providing a thin insulation film including a heat-resistant resin such as polyimide resin on the thin conductive layer. Thus, the thin insulation film is laminated on the thin conductive layer to integrate the thin insulation film with the thin conductive layer.

The carbon particles used in the resistant heat generation layer 22*b* may be known carbon black powder or carbon nanoparticles formed of at least one of carbon nanofiber, carbon nanotube, and carbon microcoil.

The metal particles used in the resistant heat generation layer 22*b* may be silver, aluminum, or nickel particles, and may be granular or filament-shaped.

The insulation layer 22*d* may be manufactured by coating the base layer 22*a* with an insulation material including a heat-resistant resin identical to the heat-resistant resin of the base layer 22*a*, such as polyimide resin.

The electrode layer 22*c* may be manufactured by coating the base layer 22*a* with a conductive ink or a conductive paste such as silver. Alternatively, metal foil or a metal mesh may be adhered to the base layer 22*a*.

The heat generation sheet 22*s* of the laminated heater 22 is a thin sheet having a small heat capacity, and is heated quickly. An amount of heat generated by the heat generation sheet 22*s* is arbitrarily set according to the volume resistivity of the resistant heat generation layer 22*b*. In other words, the amount of heat generated by the heat generation sheet 22*s* can be adjusted according to the material, shape, size, and dispersion of conductive particles of the resistant heat generation layer 22*b*. For example, the laminated heater 22 providing heat generation per unit area of 35 W/cm$^2$ outputs a total power of about 1,200 W with the heat generation sheet 22*s* having a width of about 20 cm in the axial direction of the fixing sleeve 21 and a length of about 2 cm in the circumferential direction of the fixing sleeve 21, for example.

If a metal filament, such as a stainless steel filament, is used as a laminated heater, the metal filament causes asperities to appear in the surface of the laminated heater. Consequently, when the inner circumferential surface of the fixing sleeve 21 slides over the laminated heater, the asperities of the laminated heater abrade the surface of the laminated heater easily. To address this problem, according to this exemplary embodiment, the heat generation sheet 22*s* has a smooth surface without asperities as described above, providing improved durability in particular against wear due to sliding of the inner circumferential surface of the fixing sleeve 21 over the laminated heater 22. Further, a surface of the resistant heat generation layer 22*b* of the heat generation sheet 22*s* may be coated with fluorocarbon resin to further improve durability.

In FIG. 2, the heat generation sheet 22*s* (depicted in FIG. 4) of the laminated heater 22 faces the inner circumferential surface of the fixing sleeve 21 in a region in the circumferential direction of the fixing sleeve 21 between a position on the fixing sleeve 21 opposite the nip N and a position upstream from the nip N in the rotation direction R1 of the fixing sleeve 21. Alternatively, the heat generation sheet 22*s* may face the inner circumferential surface of the fixing sleeve 21 in a region in the circumferential direction of the fixing sleeve 21 between the position on the fixing sleeve 21 opposite the nip N and a position of the nip N in the rotation direction R1 of the fixing sleeve 21. Yet alternatively, the heat generation sheet 22*s* may face the entire inner circumferential surface of the fixing sleeve 21 in the circumferential direction of the fixing sleeve 21.

Figure 5:
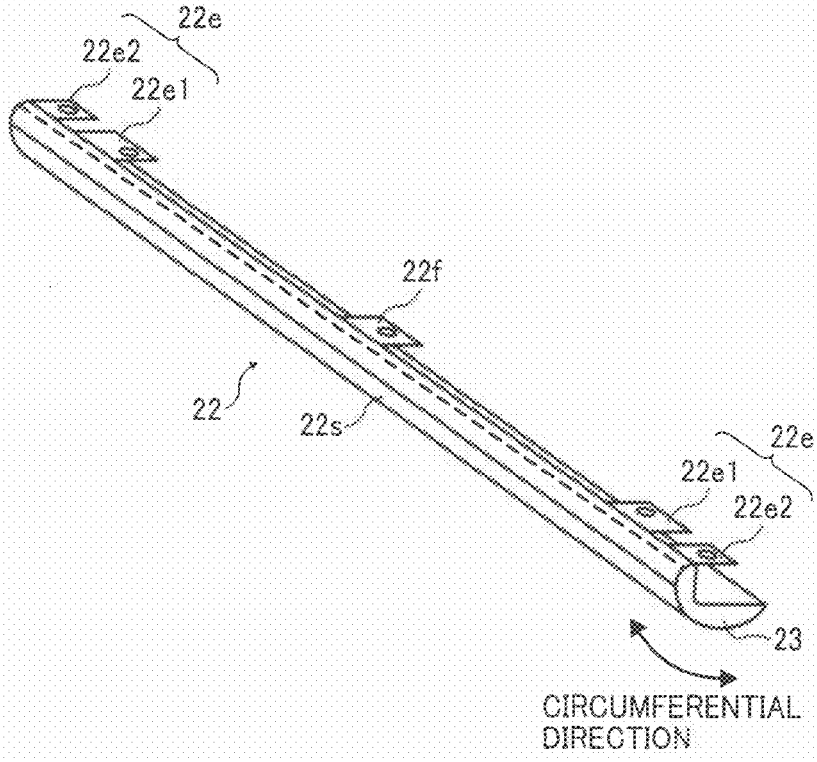
FIG. 5 is a perspective view of the laminated heater shown in FIG. 4 and a heater support included in the fixing device shown in FIG. 2.
Figure 6:
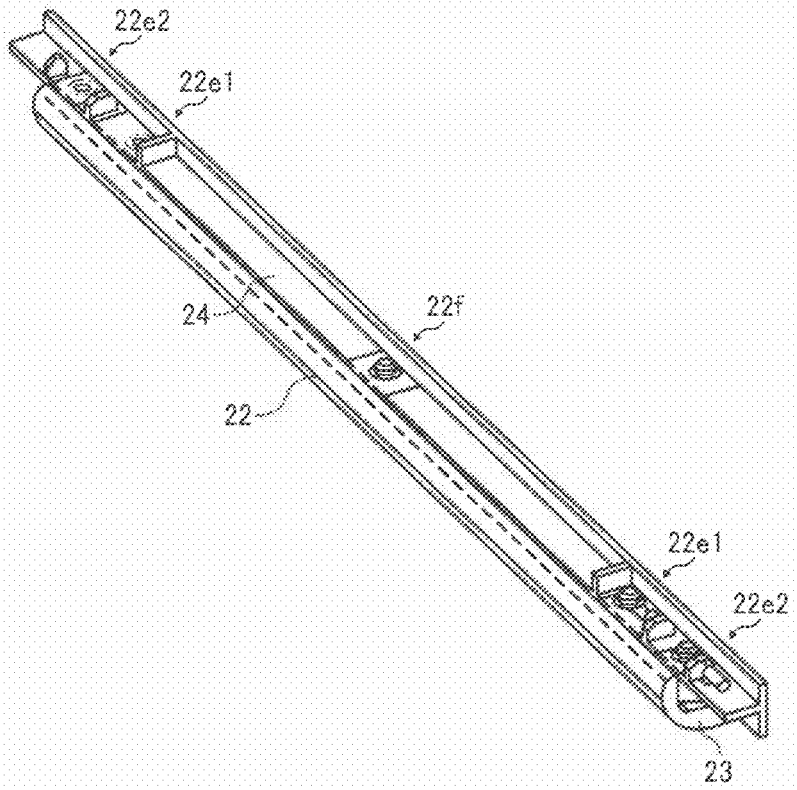
FIG. 6 is a perspective view of the laminated heater shown in FIG. 4, the heater support shown in FIG. 5, and a terminal stay included in the fixing device shown in FIG. 2.
Figure 7:
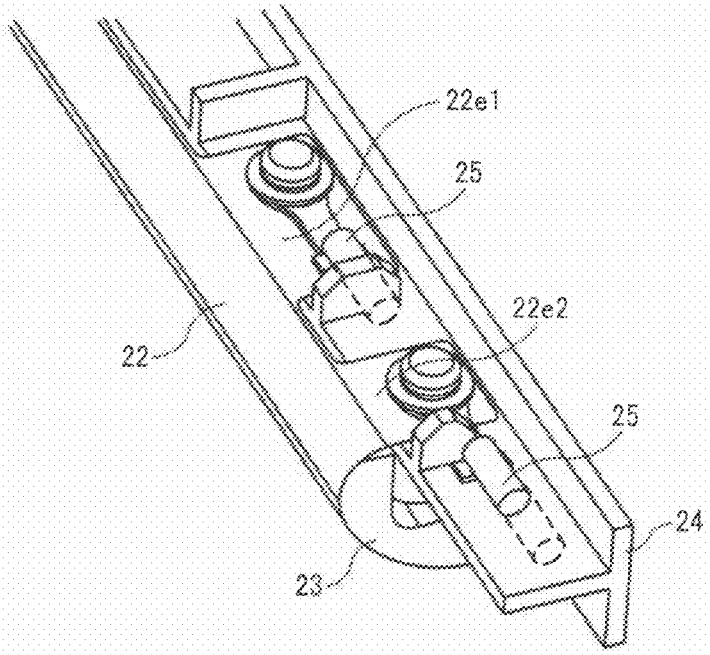
FIG. 7 is a partial perspective view of the laminated heater shown in FIG. 4, the heater support shown in FIG. 5, the terminal stay shown in FIG. 6, and a power supply wire included in the fixing device shown in FIG. 2.

Referring to FIGS. 5 to 7, the following describes assembly processes for assembling the fixing device 20, that is, steps for putting together the components provided inside the loop formed by the fixing sleeve 21. FIG. 5 is a perspective view of the laminated heater 22 and the heater support 23. FIG. 6 is a perspective view of the laminated heater 22, the heater support 23, and the terminal stay 24. FIG. 7 is a partial perspective view of the laminated heater 22, the heater support 23, the terminal stay 24, and the power supply wire 25.

As illustrated in FIG. 5, the laminated heater 22 further includes electrode terminal pairs 22*e* and an attachment terminal 22*f*. The electrode terminal pair 22*e* includes electrode terminals 22*e*1 and 22*e*2.

As illustrated in FIG. 5, the heat generation sheet 22*s* of the laminated heater 22 is adhered to the heater support 23 with an adhesive along the outer circumferential surface of the heater support 23. The adhesive may have a small heat conductivity to prevent heat transmission from the heat generation sheet 22*s* to the heater support 23.

The electrode terminal pair 22*e* is connected to the electrode layer 22*c* (depicted in FIG. 4) at an end of the heat generation sheet 22*s* in a long axis, that is, a longitudinal direction, of the laminated heater 22 parallel to the axial direction of the fixing sleeve 21, and sends power supplied from the power supply wire 25 (depicted in FIG. 7) to the electrode layer 22*c*.

The plurality of electrode terminal pairs 22*e*, which are connected to the electrode layer 22*c*, is provided on one end of the laminated heater 22 in the circumferential direction of the fixing sleeve 21. In FIG. 5, the electrode terminal pairs 22*e* are provided on an edge of one end of the laminated heater 22 disposed opposite another end of the laminated heater 22 provided closer to the nip N and the pressing roller 31 in the circumferential direction of the fixing sleeve 21. The electrode terminal pair 22*e* including the electrode terminals 22*e*1 and 22*e*2 is provided on each of lateral ends of the laminated heater 22 in the axial direction of the fixing sleeve 21.

The following describes the reasons for the above-described arrangement of the electrode terminal pairs 22*e*.

The laminated heater 22 includes at least two electrode terminal pairs 22*e* to supply power to the resistant heat generation layer 22*b* depicted in FIG. 4. For example, when one electrode terminal pair 22*e* is provided on each end of the heat generation sheet 22*s* in the circumferential direction of the fixing sleeve 21, a power source harness for power supply is connected to each electrode terminal pair 22*e*. However, the heat generation sheet 22*s* itself is a thin film with little rigidity. Accordingly, a terminal block that connects the harness to the electrode terminal pair 22*e* is provided on each end of the heat generation sheet 22*s* in the circumferential direction of the fixing sleeve 21, upsizing the fixing device 20. To address this problem, according to this exemplary embodiment, the two electrode terminal pairs 22*e* are provided on one end of the heat generation sheet 22*s* in the circumferential direction of the fixing sleeve 21 to downsize the fixing device 20.

Alternatively, the electrode terminal pairs 22*e* may be provided on one end of the heat generation sheet 22*s* in the axial direction of the fixing sleeve 21. However, when the heat generation sheet 22*s* is attached to the heater support 23 along the outer circumferential surface of the heater support 23, the electrode terminal pairs 22*e* are bent, resulting in deformation of the electrode terminal pairs 22*e* when the electrode terminal pairs 22*e* are secured with screws, complication of the electrode terminals 22*e*1 and 22*e*2, and complicated assembly. To address those problems, according to this exemplary embodiment, the plurality of electrode terminal pairs 22*e* is provided on one end of the heat generation sheet 22*s* in the circumferential direction of the fixing sleeve 21. Accordingly, even when the heat generation sheet 22*s* is attached to the heater support 23 along the outer circumferential surface of the heater support 23, the electrode terminal pairs 22*e* are not bent, facilitating assembly processes.

As illustrated in FIG. 5, the heat generation sheet 22*s* is bent along the edge of the heater support 23 near the electrode terminal pairs 22*e* in such a manner that the electrode terminal pairs 22*e* are directed to a center of the circular loop formed by the fixing sleeve 21 depicted in FIG. 2. Then, each of the electrode terminals 22*e*1 and 22*e*2 is connected to the power supply wire 25 on the terminal stay 24, and secured to the terminal stay 24 as illustrated in FIGS. 6 and 7. For example, the electrode terminals 22*e*1 and 22*e*2 are secured to the terminal stay 24 with screws, respectively, as illustrated in FIG. 7.

As illustrated in FIG. 5, the attachment terminal 22*f* is provided on and protrudes from a center of the edge of the heat generation sheet 22*s* in the long axis of the laminated heater 22. The attachment terminal 22*f* is also secured to the terminal stay 24 with a screw as illustrated in FIG. 6.

Figure 8:
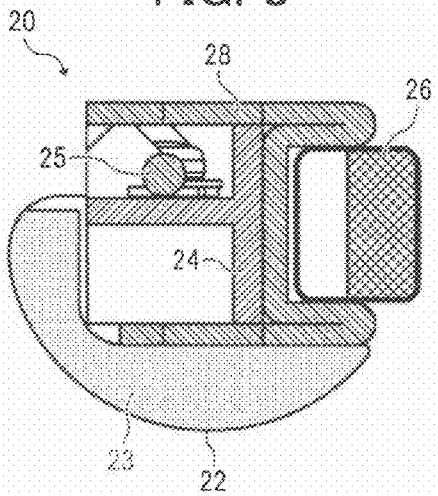
FIG. 8 is a partial sectional view of the fixing device shown in FIG. 2.

FIG. 8 is a partial sectional view of the fixing device 20 illustrating the inner components provided inside the fixing sleeve 21. As illustrated in FIG. 8, the core holder 28 is attached to the terminal stay 24 in such a manner that the second concave portion of the core holder 28 houses the terminal stay 24. Further, the nip formation member 26 is attached to the core holder 28 in such a manner that the first concave portion of the core holder 28 houses the nip formation member 26, thus completing assembly of the inner components to be provided inside the loop formed by the fixing sleeve 21.

Finally, the assembled components are inserted into the loop formed by the fixing sleeve 21 at a position illustrated in FIG. 2, completing assembly of the fixing sleeve 21 and the inner components provided inside the fixing sleeve 21 of the fixing device 20.

When the heat generation sheet 22*s* is not adhered to the heater support 23 with an adhesive, the electrode terminal pairs 22*e* and the attachment terminal 22*f*, which are provided at a fixed end of the heat generation sheet 22*s* opposite a free end of the heat generation sheet 22*s* provided near the nip N in the circumferential direction of the fixing sleeve 21, are secured to the terminal stay 24 with the screws, respectively. The rotating fixing sleeve 21 pulls the free end of the heat generation sheet 22*s* toward the nip N to tension the heat generation sheet 22*s*. Accordingly, the heat generation sheet 22*s* contacts the inner circumferential surface of the fixing sleeve 21 stably in a state in which the heat generation sheet 22*s* is sandwiched between the heater support 23 and the fixing sleeve 21. Consequently, the heat generation sheet 22*s* heats the fixing sleeve 21 effectively.

However, when the heat generation sheet 22*s* is not adhered to the heater support 23 and therefore is separated from the heater support 23, the fixing sleeve 21 rotating back to allow removal of a jammed recording medium P may lift and shift the heat generation sheet 22*s* from its proper position. Moreover, the moving heat generation sheet 22*s* may twist and deform the electrode terminal pairs 22*e*, breaking them. To address these problems, the heat generation sheet 22*s* is preferably adhered to the heater support 23 to prevent the heat generation sheet 22*s* from shifting from the proper position. Conversely, when the entire inner surface of the heat generation sheet 22*s* facing the heater support 23 is adhered to the heater support 23, heat generated by the heat generation sheet 22*s* moves from the entire inner surface of the heat generation sheet 22*s* to the heater support 23 easily. To address this problem, lateral end portions of the heat generation sheet 22*s* in the axial direction of the fixing sleeve 21, which correspond to non-conveyance regions on the fixing sleeve 21 through which the recording medium P is not conveyed, are adhered to the heater support 23 to prevent the heat generation sheet 22*s* from shifting from the proper position. Further, a center portion of the heat generation sheet 22*s* in the axial direction of the fixing sleeve 21, which corresponds to a conveyance region on the fixing sleeve 21 through which the recording medium P is conveyed, that is, a maximum conveyance region corresponding to a width of the maximum recording medium P, is not adhered to the heater support 23 and therefore is isolated from the heater support 23. Accordingly, heat is not transmitted from the center portion of the heat generation sheet 22*s* in the axial direction of the fixing sleeve 21 to the heater support 23. As a result, heat generated at the center portion of the heat generation sheet 22*s* is used effectively to heat the fixing sleeve 21.

The heat generation sheet 22*s* may be adhered to the heater support 23 with a liquid adhesive for coating. Alternatively, a tape adhesive (e.g., a double-faced adhesive tape), which provides adhesion on both sides thereof and includes a heat-resistant acryl or silicon material, may be used. Accordingly, the laminated heater 22 (e.g., the heat generation sheet 22*s*) is adhered to the heater support 23 easily. Further, if the laminated heater 22 malfunctions, the laminated heater 22 can be replaced easily by peeling off the double-faced adhesive tape, facilitating maintenance.

It is to be noted that, if the heat generation sheet 22*s* and the heater support 23 merely sandwich the double-faced adhesive tape, the lateral end portions of the heat generation sheet 22*s* in the axial direction of the fixing sleeve 21, which are adhered to the heater support 23, are lifted by a thickness of the double-faced adhesive tape. Accordingly, the center portion of the heat generation sheet 22*s* in the axial direction of the fixing sleeve 21, which is not adhered to the heater support 23, does not contact the fixing sleeve 21 uniformly, decreasing heating efficiency for heating the fixing sleeve 21 and varying temperature distribution of the fixing sleeve 21 in the axial direction of the fixing sleeve 21. To address this problem, the lateral end portions of the heat generation sheet 22*s* in the axial direction of the fixing sleeve 21, which are adhered to the heater support 23 with the double-faced adhesive tape, have a thickness decreased by the thickness of the double-faced adhesive tape.

Figure 9:
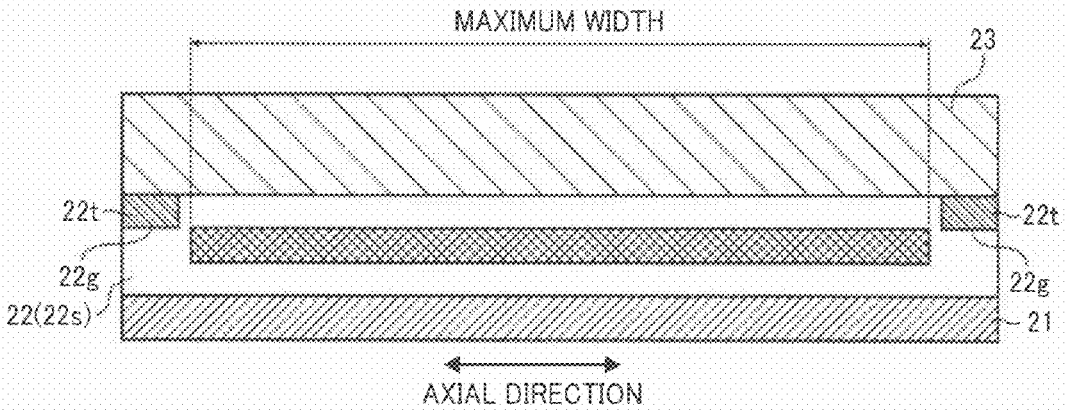
FIG. 9 is a sectional view of the heater support shown in FIG. 5, the laminated heater shown in FIG. 4, and the fixing sleeve shown in FIG. 3A illustrating edge grooves included in the laminated heater.

FIG. 9 is a sectional view of the heater support 23, the laminated heater 22, and the fixing sleeve 21. As illustrated in FIG. 9, the laminated heater 22 further includes edge grooves 22*g* and double-faced adhesive tapes 22*t*. The edge grooves 22*g* are provided at lateral edges, which correspond to the non-conveyance regions on the fixing sleeve 21 through which the recording medium P is not conveyed, of the heat generation sheet 22*s* in the axial direction of the fixing sleeve 21, respectively, on a surface of the base layer 22*a* (depicted in FIG. 4) of the heat generation sheet 22*s* that faces the heater support 23, and extend in the circumferential direction of the fixing sleeve 21. Each of the edge grooves 22*g* has a depth equivalent to the thickness (e.g., about 0.1 mm) of the double-faced adhesive tape 22*t*.

The double-faced adhesive tapes 22*t* are adhered to the edge grooves 22*g* of the heat generation sheet 22*s*, respectively, and then adhered to the heater support 23. In other words, the heat generation sheet 22*s* is adhered to the heater support 23 at predetermined positions on the heater support 23 via the double-faced adhesive tapes 22*t*. Accordingly, when the heat generation sheet 22*s* is adhered to the heater support 23, a surface of the heat generation sheet 22*s* that faces the fixing sleeve 21 is planar in the axial direction of the fixing sleeve 21. Consequently, the heat generation sheet 22*s* uniformly contacts the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction of the fixing sleeve 21.

Figure 10:
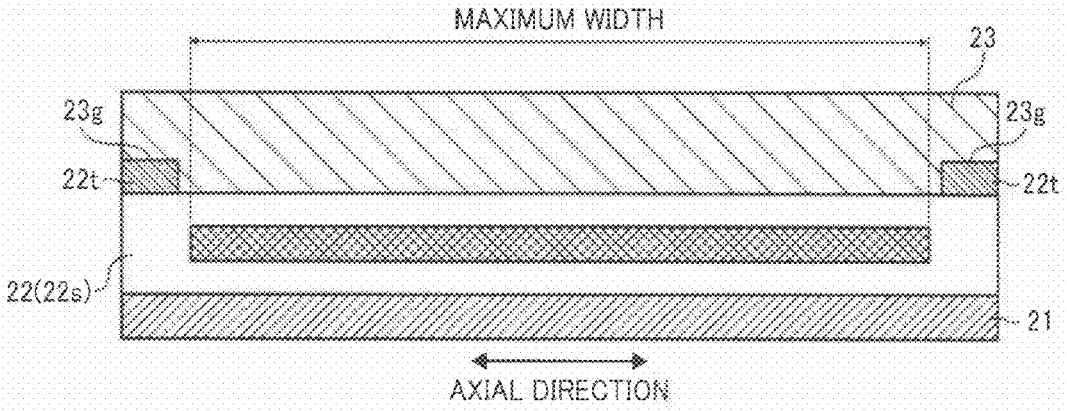
FIG. 10 is a sectional view of the heater support shown in FIG. 5, the laminated heater shown in FIG. 4, and the fixing sleeve shown in FIG. 3A illustrating edge grooves included in the heater support.

Alternatively, edge grooves may be provided in the heater support 23 instead of in the heat generation sheet 22*s*. FIG. 10 is a sectional view of the heater support 23, the laminated heater 22, and the fixing sleeve 21. As illustrated in FIG. 10, the heater support 23 includes edge grooves 23*g*.

The edge grooves 23*g* are provided at lateral edges of the heater support 23 in the axial direction of the fixing sleeve 21, which correspond to the non-conveyance regions on the fixing sleeve 21 through which the recording medium P is not conveyed, on a surface of the heater support 23 that faces the heat generation sheet 22*s*, and extend in the circumferential direction of the fixing sleeve 21. Each of the edge grooves 23*g* has a depth equivalent to the thickness of the double-faced adhesive tape 22*t*. The double-faced adhesive tapes 22*t* are adhered to the edge grooves 23*g* of the heater support 23, respectively, and then the heat generation sheet 22*s* is adhered to the heater support 23 via the double-faced adhesive tapes 22*g*. Accordingly, when the heat generation sheet 22*s* is adhered to the heater support 23, the surface of the heat generation sheet 22*s* that faces the fixing sleeve 21 is planar in the axial direction of the fixing sleeve 21. Consequently, the heat generation sheet 22*s* uniformly contacts the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction of the fixing sleeve 21.

Referring to FIGS. 1 and 2, the following describes operation of the fixing device 20 having the above-described structure.

When the image forming apparatus 1 receives an output signal, for example, when the image forming apparatus 1 receives a print request specified by a user by using a control panel or a print request sent from an external device, such as a personal computer, the pressing roller 31 is pressed against the nip formation member 26 via the fixing sleeve 21 to form the nip N between the pressing roller 31 and the fixing sleeve 21.

Thereafter, a driver drives and rotates the pressing roller 31 clockwise in FIG. 2 in the rotation direction R2. Accordingly, the fixing sleeve 21 rotates counterclockwise in FIG. 2 in the rotation direction R1 in accordance with rotation of the pressing roller 31. The laminated heater 22 supported by the heater support 23 contacts the inner circumferential surface of the fixing sleeve 21, and the fixing sleeve 21 slides over the laminated heater 22.

Simultaneously, an external power source or an internal capacitor supplies power to the laminated heater 22 via the power supply wire 25 to cause the heat generation sheet 22*s* to generate heat. The heat generated by the heat generation sheet 22*s* is transmitted effectively to the fixing sleeve 21 contacting the heat generation sheet 22*s*, so that the fixing sleeve 21 is heated quickly.

Alternatively, heating of the fixing sleeve 21 by the laminated heater 22 may not start simultaneously with driving of the pressing roller 31 by the driver. In other words, the laminated heater 22 may start heating the fixing sleeve 21 at a time different from a time at which the driver starts driving the pressing roller 31.

A temperature detector is provided at a position upstream from the nip N in the rotation direction R1 of the fixing sleeve 21. For example, the temperature detector may be provided outside the loop faulted by the fixing sleeve 21 to face the outer circumferential surface of the fixing sleeve 21 with or without contacting the fixing sleeve 21. Alternatively, the temperature detector may be provided inside the loop formed by the fixing sleeve 21 to face the heater support 23 with or without contacting the heater support 23. The temperature detector detects a temperature of the fixing sleeve 21 or the heater support 23 so that heat generation of the laminated heater 22 is controlled based on a detection result provided by the temperature detector to heat the nip N up to a predetermined fixing temperature. When the nip N is heated to the predetermined fixing temperature, the fixing temperature is maintained, and a recording medium P is conveyed to the nip N.

In the fixing device 20 according to this exemplary embodiment, the fixing sleeve 21 and the laminated heater 22 have a small heat capacity, shortening a warm-up time and a first print time of the fixing device 20 while saving energy. Further, the heat generation sheet 22*s* is a resin sheet. Accordingly, even when rotation and vibration of the pressing roller 31 applies stress to the heat generation sheet 22*s* repeatedly, and bends the heat generation sheet 22*s* repeatedly, the heat generation sheet 22*s* is not broken due to wear, and the fixing device 20 operates for a longer time.

When the image forming apparatus 1 does not receive an output signal, the pressing roller 31 and the fixing sleeve 21 do not rotate and power is not supplied to the laminated heater 22 to reduce power consumption. However, in order to restart the fixing device 20 immediately after the image forming apparatus 1 receives an output signal, power can be supplied to the laminated heater 22 while the pressing roller 31 and the fixing sleeve 21 do not rotate. For example, power in an amount sufficient to keep the entire fixing sleeve 21 warm is supplied to the laminated heater 22.

Referring to FIGS. 11A, 11B, 12, and 13, the following describes variations of the heat generation sheet 22*s* of the laminated heater 22.

In the heat generation sheet 22*s*, the resistant heat generation layer 22*b* is provided on the entire surface or a part of the surface of the base layer 22*a*. Alternatively, the resistant heat generation layer 22*b* may be divided among a plurality of regions zoned arbitrarily on the surface of the base layer 22*a* in such a manner that each resistant heat generation layer 22*b* generates heat independently.

FIG. 11A is a plan view of a laminated heater 22U as one variation of the laminated heater 22. As illustrated in FIG. 11A, the laminated heater 22U includes a heat generation sheet 22*s*U. The heat generation sheet 22*s*U includes resistant heat generation layers 22*b*1 and 22*b*2. The other elements of the laminated heater 22U are equivalent to the elements of the laminated heater 22 depicted in FIG. 4.

FIG. 11A is a plan view of the laminated heater 22U spread on a flat surface before the laminated heater 22U is adhered to the heater support 23 depicted in FIG. 2. A horizontal direction in FIG. 11A is a width direction of the laminated heater 22U corresponding to the axial direction of the fixing sleeve 21. A vertical direction in FIG. 11A is a circumferential direction of the laminated heater 22U corresponding to the circumferential direction of the fixing sleeve 21.

As illustrated in FIG. 11A, the heat generation sheet 22*s*U is divided into three regions on the surface of the heat generation sheet 22*s*U in the width direction of the heat generation sheet 22*s*U, that is, in the axial direction of the fixing sleeve 21. Further, the heat generation sheet 22*s*U is divided into two regions on the surface of the heat generation sheet 22*s*U in the circumferential direction of the heat generation sheet 22*s*U and the fixing sleeve 21. Thus, in total, the heat generation sheet 22*s*U is divided into six regions.

FIG. 11B is a lookup table of a matrix with two rows in the circumferential direction of the fixing sleeve 21 and three columns in the axial direction of the fixing sleeve 21, referred to as a 2-by-3 array of 6 elements corresponding to the six regions. The resistant heat generation layer 22*b*1 having a predetermined width and length is provided in the element (1, 2) corresponding to the region provided at a lower center portion of the heat generation sheet 22*s*U in FIG. 11A in the axial direction of the fixing sleeve 21. The resistant heat generation layers 22*b*2 having a predetermined width and length are provided in the elements (2, 1) and (2, 3) corresponding to the regions provided at upper lateral end portions of the heat generation sheet 22*s*U in FIG. 11A in the axial direction of the fixing sleeve 21, respectively.

The electrode layers 22*c* connected to the resistant heat generation layer 22*b*1 are provided in the elements (1, 1) and (1, 3) corresponding to the regions provided at lower lateral end portions of the heat generation sheet 22*s*U in FIG. 11A in the axial direction of the fixing sleeve 21, respectively. Each of the electrode layers 22*c* is connected to the electrode terminal 22*e*1 that protrudes from one edge, that is, a lower edge in FIG. 11A, of the heat generation sheet 22*s*U, forming a first heat generation circuit.

The electrode layer 22*c* connected to and sandwiched between the two resistant heat generation layers 22*b*2 is provided in the element (2, 2) corresponding to the region provided at an upper center portion of the heat generation sheet 22*s*U in FIG. 11A in the axial direction of the fixing sleeve 21. Each of the two resistant heat generation layers 22*b*2 is connected to the electrode layer 22*c* that extends to the lower edge of the heat generation sheet 22*s*U in FIG. 11A in the circumferential direction of the heat generation sheet 22*s*U. Each of the electrode layers 22*c* is connected to the electrode terminal 22*e*2 that protrudes from the lower edge of the heat generation sheet 22*s*U, forming a second heat generation circuit.

The insulation layer 22*d* is provided between the first heat generation circuit and the second heat generation circuit to prevent a short circuit of the first heat generation circuit and the second heat generation circuit.

In the laminated heater 22U having the above-described configuration, when the electrode terminals 22*e*1 supply power to the heat generation sheet 22*s*U, internal resistance of the resistant heat generation layer 22*b*1 generates Joule heat. By contrast, the electrode layers 22*c* do not generate heat due to their low resistance. Accordingly, only the region of the heat generation sheet 22*s*U shown by the element (1, 2) generates heat to heat the center portion of the fixing sleeve 21 in the axial direction of the fixing sleeve 21.

On the other hand, when the electrode terminals 22*e*2 supply power to the heat generation sheet 22*s*U, internal resistance of the resistant heat generation layers 22*b*2 generates Joule heat. By contrast, the electrode layers 22*c* do not generate heat due to their low resistance. Accordingly, only the regions of the heat generation sheet 22*s*U shown by the elements (2, 1) and (2, 3), respectively, generate heat to heat the lateral end portions of the fixing sleeve 21 in the axial direction of the fixing sleeve 21.

When a small size recording medium P having a small width passes through the fixing device 20, power is supplied to the electrode terminals 22*e*1 to heat only the center portion of the heat generation sheet 22*s*U in the axial direction of the fixing sleeve 21. By contrast, when a large size recording medium P having a large width passes through the fixing device 20, power is supplied to the electrode terminals 22*e*1 and 22*e*2 to heat the heat generation sheet 22*s*U throughout the entire width thereof in the axial direction of the fixing sleeve 21. Thus, the fixing device 20 provides desired fixing according to the width of the recording medium P with reduced energy consumption.

The controller 10 depicted in FIG. 1, that is, a central processing unit (CPU), controls an amount of heat generated by the laminated heater 22U according to the size of the recording medium P. Accordingly, even when the small size recording media P pass through the fixing device 20 continuously, the lateral end portions of the heat generation sheet 22*s*U corresponding to the non-conveyance regions of the fixing sleeve 21 over which the recording medium P is not conveyed, respectively, are not overheated, thus preventing stoppage of the fixing device 20 to protect the components of the fixing device 20 and decrease of productivity of the fixing device 20. The single, divided laminated heater 22U provides varied regions of the heat generation sheet 22*s*U, reducing temperature variation of the laminated heater 22U in the axial direction of the fixing sleeve 21 compared to a plurality of separate, laminated heaters.

Edges of each of the resistant heat generation layers 22*b*1 and 22*b*2 contacting the insulation layers 22*d* or the electrode layers 22*c* having a relatively high heat conductivity generate a smaller amount of heat due to heat transmission from the resistant heat generation layers 22*b*1 and 22*b*2 to the insulation layers 22*d* or the electrode layers 22*c*. Accordingly, in the configuration illustrated in FIG. 11A in which a border between the center, resistant heat generation layer 22*b*1 and the adjacent electrode layer 22*c* and a border between the lateral, resistant heat generation layer 22*b*2 and the adjacent electrode layer 22*c* are provided on an identical face, when power is supplied to the electrode terminals 22*e*1 and 22*e*2, such borders have a decreased temperature, varying temperature distribution of the laminated heater 22U in the axial direction of the fixing sleeve 21. As a result, a faulty toner image is formed due to faulty fixing.

To address this problem, FIG. 12 illustrates a laminated heater 22V as another variation of the laminated heater 22. FIG. 12 is a plan view of the laminated heater 22V. As illustrated in FIG. 12, the laminated heater 22V includes a heat generation sheet 22*s*V. The heat generation sheet 22*s*V includes a resistant heat generation layer 22*b*1V replacing the resistant heat generation layer 22*b*1 depicted in FIG. 11A. The other elements of the laminated heater 22V are equivalent to the elements of the laminated heater 22U depicted in FIG. 11A.

The resistant heat generation layer 22*b*1V has a longer width in the axial direction of the fixing sleeve 21. Accordingly, the resistant heat generation layer 22*b*1V partially overlaps each of the resistant heat generation layers 22*b*2 in a width direction of the heat generation sheet 22*s*V, that is, in the axial direction of the fixing sleeve 21, to form an overlap region V. Accordingly, when power is supplied to the electrode terminals 22*e*1 and 22*e*2, temperature decrease is prevented at a border between the resistant heat generation layer 22*b*1V and the adjacent electrode layer 22*c* and a border between the resistant heat generation layer 22*b*2 and the adjacent electrode layer 22*c*.

Figure 13:
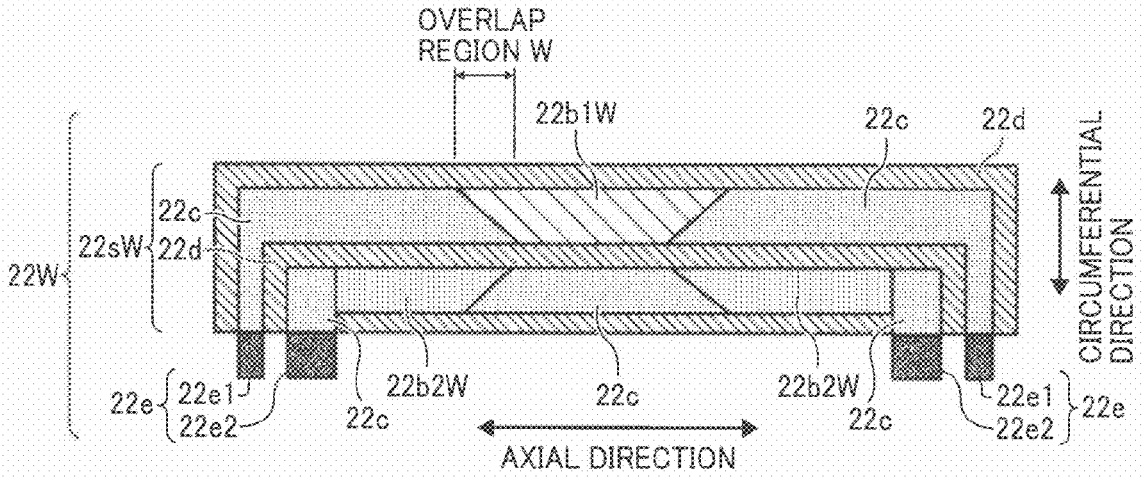
FIG. 13 is a plan view of a laminated heater as yet another variation of the laminated heater shown in FIG. 4.

FIG. 13 is a plan view of a laminated heater 22W as yet another variation of the laminated heater 22. As illustrated in FIG. 13, the laminated heater 22W includes a heat generation sheet 22*s*W. The heat generation sheet 22*s*W includes resistant heat generation layers 22*b*1W and 22*b*2W replacing the resistant heat generation layers 22*b*1V and 22*b*2 depicted in FIG. 12, respectively. The other elements of the laminated heater 22W are equivalent to the elements of the laminated heater 22V depicted in FIG. 12.

The resistant heat generation layer 22*b*1W partially overlaps each of the resistant heat generation layers 22*b*2W to form an overlap region W. In each overlap region W, a border between the resistant heat generation layer 22*b*1W and the adjacent electrode layer 22*c* is tapered with respect to the circumferential direction of the heat generation sheet 22*s*W in a direction opposite a direction in which a border between the resistant heat generation layer 22*b*2W and the adjacent electrode layer 22*c* is tapered with respect to the circumferential direction of the heat generation sheet 22*s*W. Thus, an amount of overlap of the resistant heat generation layer 22*b*1W and the resistant heat generation layer 22*b*2W is adjusted.

With the configuration shown in FIG. 12, a width of the overlap region V in which the resistant heat generation layer 22*b*1V overlaps the resistant heat generation layer 22*b*2 in the width direction of the heat generation sheet 22*s*V, that is, in the axial direction of the fixing sleeve 21, is unchanged. Accordingly, if the width of the overlap region V varies, an amount of heat generated by the heat generation sheet 22*s*V varies. To address this problem, with the configuration shown in FIG. 13, the width of the overlap region W changes in the circumferential direction of the heat generation sheet 22*s*W. For example, the width of the overlap region W of the resistant heat generation layer 22*b*1W and the width of the overlap region W of the resistant heat generation layer 22*b*2W decrease at a predetermined rate in a downward direction in FIG. 13. Accordingly, heat generation distribution is adjusted to reduce adverse effects of production errors of the laminated heater 22W. As a result, the laminated heater 22W provides uniform temperature throughout the axial direction of the fixing sleeve 21.

In the laminated heater 22U depicted in FIG. 11A, portions on the surface of the base layer 22*a* on which the resistant heat generation layers 22*b*1 and 22*b*2 are to be provided are exposed and coated to form the resistant heat generation layers 22*b*1 and 22*b*2. Then, portions on the surface of the base layer 22*a* on which the insulation layers 22*d* are to be provided are exposed and coated to form the insulation layers 22*d* formed of heat-resistant resin. Thereafter, portions on the surface of the base layer 22*a* on which the electrode layers 22*c* are to be provided are exposed and coated with a conductive paste to form the electrode layers 22*c*. In other words, exposure of the portions on the surface of the base layer 22*a* on which the resistant heat generation layers 22*b*1 and 22*b*2 are to be provided is adjusted to form the resistant heat generation layers 22*b*1 and 22*b*2 having an arbitrary shape. Similarly, the resistant heat generation layers 22*b*1V and 22*b*2 of the laminated heater 22V depicted in FIG. 12 and the resistant heat generation layers 22*b*1W and 22*b*2W of the laminated heater 22W depicted in FIG. 13 are formed.

Figure 14:
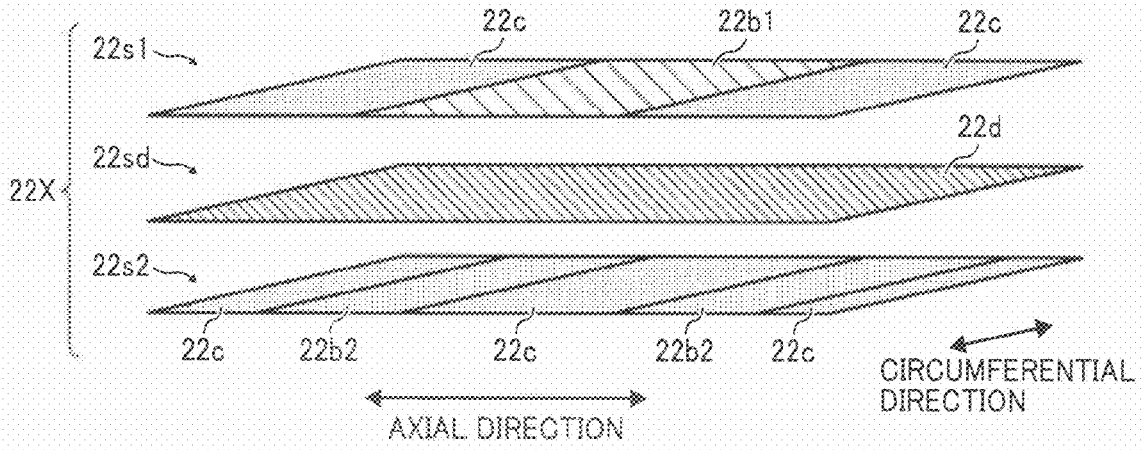
FIG. 14 is an exploded perspective view of a laminated heater as yet another variation of the laminated heater shown in FIG. 4.

The laminated heater (e.g., the laminated heater 22, 22U, 22V, or 22W) may include a plurality of layered heat generation sheets in each of which one or more resistant heat generation layers are provided on an arbitrary portion on the surface of the base layer 22*a* in such a manner that the resistant heat generation layers generate heat independently from each other. FIG. 14 illustrates a laminated heater 22X including a plurality of heat generation sheets.

FIG. 14 is an exploded perspective view of the laminated heater 22X. As illustrated in FIG. 14, the laminated heater 22X includes a first heat generation sheet 22*s*1, an insulation sheet 22*sd*, and a second heat generation sheet 22*s*2. The first heat generation sheet 22*s*1 includes the resistant heat generation layer 22*b*1 and the electrode layers 22*c*. The insulation sheet 22*sd* includes the insulation layer 22*d*. The second heat generation sheet 22*s*2 includes the resistant heat generation layers 22*b*2 and the electrode layers 22*c*.

The first heat generation sheet 22*s*1 is provided on the insulation sheet 22*sd* provided on the second heat generation sheet 22*s*2.

The first heat generation sheet 22*s*1 is divided into three regions on a surface of the first heat generation sheet 22*s*1 in a width direction of the first heat generation sheet 22*s*1, that is, in the axial direction of the fixing sleeve 21. The resistant heat generation layer 22*b*1 is provided in the center region on the surface of the first heat generation sheet 22*s*1. The electrode layers 22*c*, which are connected to the adjacent resistant heat generation layer 22*b*1, are provided in the lateral end regions on the surface of the first heat generation sheet 22*s*1, respectively.

The second heat generation sheet 22*s*2 is divided into five regions on a surface of the second heat generation sheet 22*s*2 in a width direction of the second heat generation sheet 22*s*2, that is, in the axial direction of the fixing sleeve 21. The resistant heat generation layers 22*b*2 are provided in the second and fourth regions from left to right in FIG. 14, respectively. The electrode layers 22*c*, which are connected to the adjacent resistant heat generation layers 22*b*2, are provided in the first, third, and fifth regions from left to right in FIG. 14, respectively.

The first heat generation sheet 22*s*1 is provided on the second heat generation sheet 22*s*2 via the insulation sheet 22*sd* in such a manner that the first heat generation sheet 22*s*1 and the second heat generation sheet 22*s*2 sandwich the insulation sheet 22*sd*. Thus, an independent first heat generation circuit is provided in the first heat generation sheet 22*s*1, and another independent second heat generation circuit is provided in the second heat generation sheet 22*s*2.

When power is supplied to the first heat generation circuit, internal resistance of the resistant heat generation layer 22*b*1 generates Joule heat, and the center region on the surface of the first heat generation sheet 22*s*1 in the width direction of the first heat generation sheet 22*s*1 generates heat to heat the center portion of the fixing sleeve 21 in the axial direction of the fixing sleeve 21. When power is supplied to the second heat generation circuit, internal resistance of the resistant heat generation layers 22*b*2 generates Joule heat, and the lateral end regions on the surface of the second heat generation sheet 22*s*2 in the width direction of the second heat generation sheet 22*s*2 generate heat to heat the lateral end portions of the fixing sleeve 21 in the axial direction of the fixing sleeve 21.

If the laminated heater 22X is divided in a circumferential direction of the laminated heater 22X as in the laminated heaters 22U, 22V, and 22W depicted in FIGS. 11A, 12, and 13, respectively, the laminated heater 22X need to have an increased area to provide a desired heat generation amount, and therefore is not installed inside the small fixing sleeve 21 having a small diameter. To address this problem, the laminated heater 22X includes the plurality of heat generation sheets layered in a thickness direction, that is, the second heat generation sheet 22*s*2 and the first heat generation sheet 22*s*1 provided on the second heat generation sheet 22*s*2 in such a manner that the resistant heat generation layer 22*b*1 of the first heat generation sheet 22*s*1 is shifted from the resistant heat generation layers 22*b*2 of the second heat generation sheet 22*s*2 in the width direction of the laminated heater 22X as illustrated in FIG. 14. Accordingly, the laminated heater 22X provides varied heat generation distribution in the axial direction of the fixing sleeve 21 like the laminated heaters 22U, 22V, and 22W depicted in FIGS. 11A, 12, and 13, respectively, providing an increased output of heat while saving space and downsizing the fixing device 20.

As illustrated in FIG. 2, when the fixing sleeve 21 rotates, the pressing roller 31 pulls the fixing sleeve 21 at the nip N. Accordingly, the pressing roller 31 applies tension to an upstream portion of the fixing sleeve 21 provided upstream from the nip N in the rotation direction R1 of the fixing sleeve 21. Consequently, the inner circumferential surface of the fixing sleeve 21 slides over the laminated heater 22 in a state in which the fixing sleeve 21 is pressed against the heater support 23. By contrast, the pressing roller 31 does not apply tension to a downstream portion of the fixing sleeve 21 provided downstream from the nip N in the rotation direction R1 of the fixing sleeve 21. Accordingly, the downstream portion of the fixing sleeve 21 remains slack, a situation that is exacerbated if the fixing sleeve 21 rotates faster and destabilizing the rotation of the fixing sleeve 21.

To address this problem, the fixing device 20 may include a fixing member support provided inside the loop formed by the fixing sleeve 21 to support at least the downstream portion of the fixing sleeve 21. FIGS. 15A, 15B, 15C, 15D, and 15E illustrate such fixing member support.

Figure 15A:
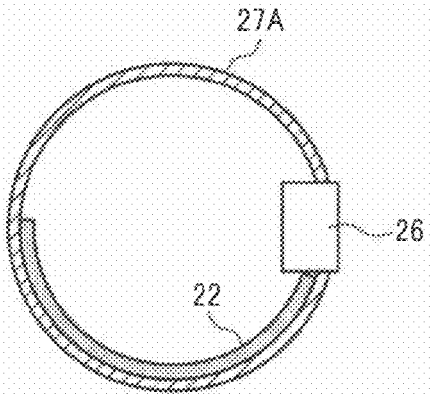
FIG. 15A is a sectional view of a fixing sleeve support, a laminated heater, and a nip formation member included in the fixing device shown in FIG. 2 illustrating the laminated heater provided inside the fixing sleeve support.

FIG. 15A is a sectional view of a fixing sleeve support 27A, the laminated heater 22, and the nip formation member 26. The fixing sleeve support 27A is a metal member serving as a fixing member support, for example, a thin, stainless steel pipe. The laminated heater 22 is provided on an inner circumferential surface of the fixing sleeve support 27A, and an outer circumferential surface of the fixing sleeve support 27A supports the fixing sleeve 21 depicted in FIG. 2, providing stable rotation of the fixing sleeve 21. Further, the rigid, metal fixing sleeve support 27A supports the fixing sleeve 21, facilitating assembly of the fixing device 20. The fixing sleeve 21 does not slide over the laminated heater 22 by contacting the laminated heater 22, preventing wear of a protective layer (e.g., a sliding layer) and an insulation layer provided on the surface of the laminated heater 22 which may be caused by the fixing sleeve 21 sliding over the laminated heater 22. Accordingly, electric conductors, such as the resistant heat generation layers 22*b* and the electrode layers 22*c*, are not exposed, preventing short circuiting. However, the metal fixing sleeve support 27A has a substantial heat capacity, providing a slower speed at which the temperature of the fixing sleeve 21 increases during warm-up than the structure shown in FIG. 2 that does not include the fixing sleeve support 27A.

Figure 15B:
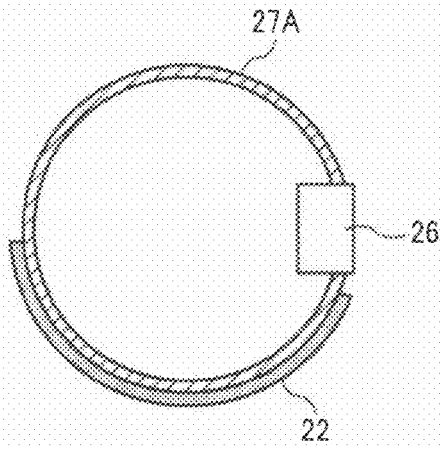
FIG. 15B is a sectional view of a fixing sleeve support, a laminated heater, and a nip formation member included in the fixing device shown in FIG. 2 illustrating the laminated heater provided outside the fixing sleeve support.

FIG. 15B is a sectional view of the fixing sleeve support 27A, the laminated heater 22, and the nip formation member 26 as a variation of the structure shown in FIG. 15A. As illustrated in FIG. 15B, the laminated heater 22 is provided on the outer circumferential surface of the fixing sleeve support 27A to transmit heat to the fixing sleeve 21 more quickly than the laminated heater 22 provided on the inner circumferential surface of the fixing sleeve support 27A shown in FIG. 15A. However, heat is adversely transmitted from an inner circumferential surface of the laminated heater 22 facing the fixing sleeve support 27A to the fixing sleeve support 27A.

Figure 15C:
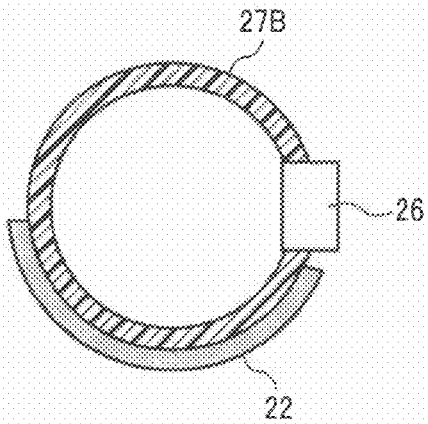
FIG. 15C is a sectional view of a fixing sleeve support as one variation of the fixing sleeve support shown in FIG. 15B.

To address this problem, the fixing device 20 may include a fixing sleeve support 27B, instead of the fixing sleeve support 27A, which has a heat conductivity smaller than that of the metal fixing sleeve support 27A as in FIG. 15C. FIG. 15C is a sectional view of the fixing sleeve support 27B, the laminated heater 22, and the nip formation member 26. The fixing sleeve support 27B, serving as a fixing member support, includes solid resin having a heat conductivity smaller than that of the metal fixing sleeve support 27A, suppressing heat transmission from the inner circumferential surface of the laminated heater 22 facing the fixing sleeve support 27B to the fixing sleeve support 27B. However, a heat resistance of resin is generally smaller than that of metal, and resin having a high heat resistance is expensive, resulting in increased manufacturing costs.

Figure 15D:
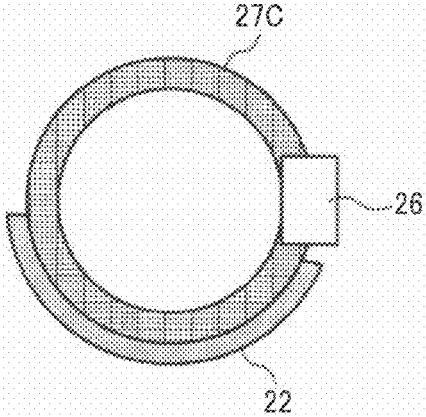
FIG. 15D is a sectional view of a fixing sleeve support as another variation of the fixing sleeve support shown in FIG. 15B.

To address this problem, the fixing device 20 may include a fixing sleeve support 27C instead of the fixing sleeve support 27B. The fixing sleeve support 27C is formed of polyimide resin foam that provides heat insulation and rigidity. FIG. 15D is a sectional view of the fixing sleeve support 27C, the laminated heater 22, and the nip formation member 26. The fixing sleeve support 27C serves as a fixing member support that supports the fixing sleeve 21 serving as a fixing member.

Figure 15E:
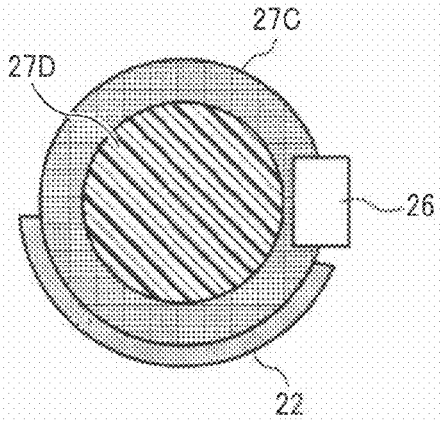
FIG. 15E is a sectional view of a resin support provided inside the fixing sleeve support shown in FIG. 15D.

FIG. 15E is a sectional view of the fixing sleeve support 27C, the laminated heater 22, the nip formation member 26, and a resin member 27D for enhanced rigidity. The resin member 27D is formed of polyimide foam, and is provided inside the fixing sleeve support 27C in such a manner that the resin member 27D contacts an inner circumferential surface of the fixing sleeve support 27C, providing an improved rigidity.

Figure 16:
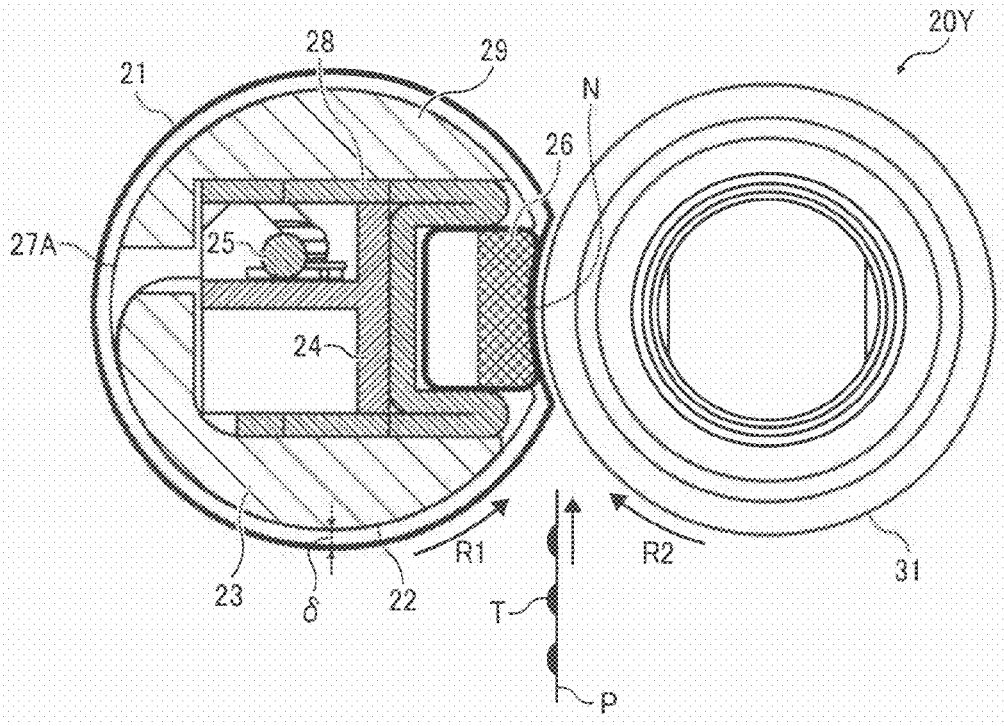
FIG. 16 is a sectional view of a fixing device according to another exemplary embodiment of the present invention.

Referring to FIG. 16, the following describes a fixing device 20Y according to another exemplary embodiment. FIG. 16 is a sectional view of the fixing device 20Y. As illustrated in FIG. 16, the fixing device 20Y includes the fixing sleeve 21, the laminated heater 22, the heater support 23, the terminal stay 24, the power supply wire 25, the nip formation member 26, the fixing sleeve support 27A, the core holder 28, an insulation support 29, and the pressing roller 31. In other words, the fixing device 20Y has the structure shown in FIG. 2 and the structure shown in FIG. 15A.

The pipe-shaped fixing sleeve support 27A is provided inside the loop formed by the fixing sleeve 21. The insulation support 29 is provided inside a loop formed by the fixing sleeve support 27A and downstream from the nip N in the rotation direction R1 of the fixing sleeve 21. The insulation support 29 contacts an outer surface of the H-shaped core holder 28.

The fixing sleeve support 27A is, for example, a thin metal pipe having a thickness in a range of from about 0.1 mm to about 1.0 mm, and includes iron, stainless steel, and/or the like. An outer diameter of the fixing sleeve support 27A is smaller than an inner diameter of the fixing sleeve 21 by a length in a range of from about 0.5 mm to about 1.0 mm. The fixing sleeve support 27A is cut along a long axis, that is, a longitudinal direction, of the fixing sleeve support 27A parallel to the axial direction of the fixing sleeve 21, and therefore includes an opening facing the nip N. Cut ends of the fixing sleeve support 27A are folded in toward the core holder 28, so that the cut ends of the fixing sleeve support 27A do not contact the inner circumferential surface of the fixing sleeve 21 at the nip N.

The insulation support 29 is provided downstream from the nip N in the rotation direction R1 of the fixing sleeve 21. The insulation support 29 has a heat resistance that resists heat applied by the fixing sleeve 21 via the fixing sleeve support 27A, a heat insulation that prevents heat transmission from the fixing sleeve support 27A contacting the fixing sleeve 21 to the insulation support 29, and a strength that supports the fixing sleeve support 27A in such a manner that the fixing sleeve support 27A is not deformed by the fixing sleeve 21 that rotates and slides over the fixing sleeve support 27A. The insulation support 29 includes polyimide resin foam like the heater support 23.

Figure 17:
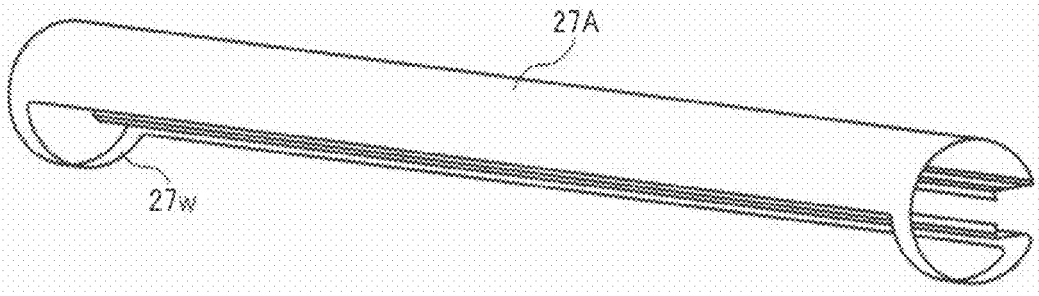
FIG. 17 is a perspective view of a fixing sleeve support included in the fixing device shown in FIG. 16.
Figure 18A:
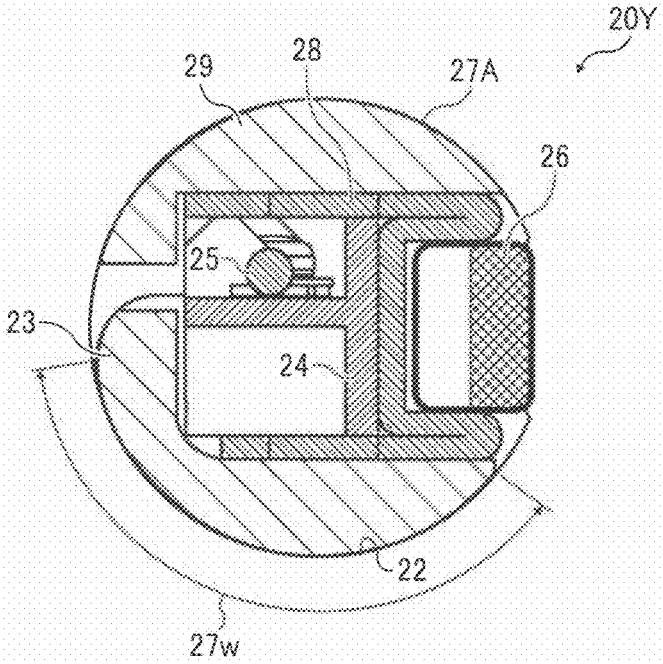
FIG. 18A is a partial sectional view of the fixing device shown in FIG. 16.
Figure 18B:
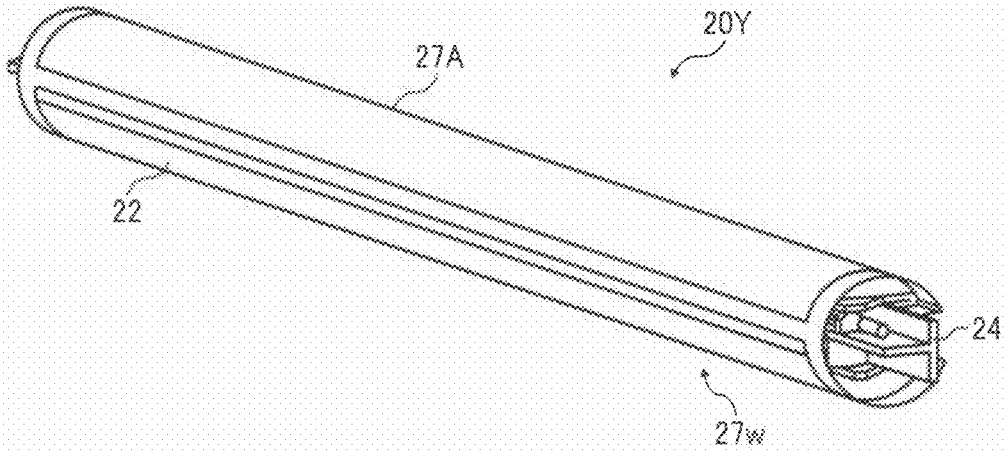
FIG. 18B is a perspective view of the fixing device shown in FIG. 18A.

FIG. 17 is a perspective view of the fixing sleeve support 27A. As illustrated in FIG. 17, the fixing sleeve support 27A includes a window 27*w*. FIG. 18A is a partial sectional view of the fixing device 20Y. FIG. 18B is a partial perspective view of the fixing device 20Y.

As illustrated in FIG. 17, a predetermined region on a circumferential surface of the fixing sleeve support 27A provided upstream from the nip N in the rotation direction R1 of the fixing sleeve 21 is cut away to provide the window 27*w*. Accordingly, when the components provided inside the loop formed by the fixing sleeve 21 are arranged as illustrated in FIG. 18A and are inserted into the fixing sleeve 21, the entire outer circumferential surface of the laminated heater 22 is exposed through the window 27*w* as illustrated in FIG. 18B. Consequently, the laminated heater 22 is disposed close to the inner circumferential surface of the fixing sleeve 21.

As illustrated in FIG. 16, the laminated heater 22 (e.g., the heat generation sheet 22*s*) is supported by the heater support 23, and is disposed close to the inner circumferential surface of the fixing sleeve 21 with a predetermined gap δ provided therebetween. The predetermined gap δ is smaller than the thickness of the fixing sleeve support 27A, that is, greater than 0 mm but not greater than 1 mm. Accordingly, the laminated heater 22 heats the fixing sleeve 21 quickly and effectively.

In both of the fixing devices 20 and 20Y depicted in FIGS. 2 and 16, respectively, the fixing sleeve 21 and the laminated heater 22 have a small heat capacity, shortening a warm-up time and a first print time while saving energy. The heat generation sheet 22*s* of the laminated heater 22 is a resin-based sheet. Accordingly, even when rotation and vibration of the pressing roller 31 stress the heat generation sheet 22*s* repeatedly and bend the heat generation sheet 22*s* repeatedly, the heat generation sheet 22*s* is not broken by wear, providing long-duration operation. The laminated heater 22 generates heat in various portions thereof in the axial direction of the fixing sleeve 21, providing effective temperature control of the fixing sleeve 21 according to the size of the recording medium P passing through the fixing device 20 or 20Y. Further, in addition to the fixing sleeve support 27A, the insulation support 29 is added as needed, improving stable rotation of the fixing sleeve 21 and suppressing formation of a faulty toner image even when the fixing sleeve 21 rotates at a higher speed. The fixing sleeve support 27A, which conducts heat in the axial direction of the fixing sleeve 21, is provided to facilitate uniform temperature of the fixing sleeve 21 in the axial direction of the fixing sleeve 21. Accordingly, the fixing sleeve 21 provides a desired fixing property even when the fixing sleeve 21 rotates at a higher speed.

The image forming apparatus 1 (depicted in FIG. 1) that includes either the fixing device 20 or 20Y provides a shortened warm-up time and a shortened first print time. Even when the size of the recording medium P varies, the image forming apparatus 1 forms a desired toner image on the recording medium P while reducing energy consumption. Further, even when the image forming apparatus 1 forms a toner image at a higher speed, the fixing device 20 or 20Y suppresses formation of a faulty toner image.

In the fixing devices 20 and 20Y according to the above-described exemplary embodiments, the pressing roller 31 is used as a pressing member. Alternatively, a pressing belt, a pressing pad, or a pressing plate may be used as a pressing member to provide effects equivalent to the effects provided by the pressing roller 31.

Further, the fixing sleeve 21 is used as a fixing member. Alternatively, an endless fixing belt or an endless fixing film may be used as a fixing member.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

an endless belt-shaped fixing member rotating in a predetermined direction of rotation, formed in a loop;

a pressing member contacting an outer circumferential surface of the fixing member to form a nip between the pressing member and the fixing member through which the recording medium bearing the toner image passes;

a laminated heater facing an inner circumferential surface of the fixing member to heat the fixing member; and a heater support provided inside the loop formed by the fixing member to support the laminated heater, the laminated heater provided between the fixing member and the heater support and comprising a flexible, first heat generation sheet having a predetermined length in a circumferential direction of the fixing member and a width in an axial direction of the fixing member, the first heat generation sheet comprising:

an insulating base layer;

at least one resistant heat generation layer provided on the base layer to generate heat; and at least one electrode layer, provided on a surface of the base layer parallel to a direction of travel of the recording medium, to supply power to the at least one resistant heat generation layer, wherein the laminated heater further comprises a second heat generation sheet provided on the first heat generation sheet, and comprising:

an insulating base layer;

at least one resistant heat generation layer provided on the base layer to generate heat; and at least one electrode layer provided on the base layer to supply power to the at least one resistant heat generation layer, and wherein the second heat generation sheet is divided into a plurality of regions and the at least one resistant heat generation layer is provided in at least one of the plurality of regions to generate heat independently.

2. The fixing device according to claim 1, further comprising a nip formation member provided inside the loop formed by the fixing member and pressed against the pressing member via the fixing member to form the nip between the pressing member and the fixing member through which the recording medium bearing the toner image passes.

3. The fixing device according to claim 1, wherein each of the at least one resistant heat generation layer includes conductive particles dispersed in a heat-resistant resin.

4. The fixing device according to claim 1, wherein the first heat generation sheet is divided into a plurality of regions and the plurality of resistant heat generation layers is provided in the plurality of regions, respectively, to generate heat independently.

5. The fixing device according to claim 4, wherein the plurality of regions of the first heat generation sheet includes a center region and lateral end regions in the axial direction of the fixing member.

6. The fixing device according to claim 1, wherein the plurality of regions of the second heat generation sheet includes a center region and lateral end regions in the axial direction of the fixing member.

7. The fixing device according to claim 1, wherein the laminated heater further comprises a plurality of electrode terminals provided at one edge of the first heat generation sheet in the circumferential direction of the fixing member and connected to the plurality of electrode layers.

8. The fixing device according to claim 1, wherein the at least one resistant heat generation layer is coated on the base layer.

9. The fixing device according to claim 1, further comprising a fixing member support provided inside the loop formed by the fixing member and downstream from the nip in the direction of rotation of the fixing member to support the rotating fixing member.

10. The fixing device according to claim 1, wherein the first heat generation sheet further comprises edge grooves provided at lateral edges of the first heat generation sheet in the axial direction of the fixing member, respectively, over which the recording medium bearing the toner image does not pass, and wherein an adhesive is provided in the edge grooves to adhere the first heat generation sheet to the heater support.

11. The fixing device according to claim 10, wherein the adhesive is a double-faced adhesive tape, and a depth of each of the edge grooves of the first heat generation sheet is equivalent to a thickness of the double-faced adhesive tape.

12. The fixing device according to claim 1, wherein the heater support comprises edge grooves provided at lateral edges of the heater support in the axial direction of the fixing member, respectively, over which the recording medium bearing the toner image does not pass, and wherein an adhesive is provided in the edge grooves to adhere the first heat generation sheet to the heater support.

13. The fixing device according to claim 12, wherein the adhesive is a double-faced adhesive tape, and a depth of each of the edge grooves of the heater support is equivalent to a thickness of the double-faced adhesive tape.

14. An image forming apparatus comprising the fixing device according to claim 1.

* * * * *